United States Patent [19]

Nissen et al.

[11] 4,120,366

[45] Oct. 17, 1978

[54] MOUNTING ARRANGEMENT FOR DOZER BLADE

[75] Inventors: Roland N. Nissen, Wichita; James S. Flippin, Clearwater, both of Kans.

[73] Assignee: J. I. Case Company, Racine, Wis.

[21] Appl. No.: 829,221

[22] Filed: Aug. 31, 1977

[51] Int. Cl.[2] ..... E02F 3/76

[52] U.S. Cl. ..... 172/805; 172/807

[58] Field of Search ..... 172/807, 806, 804, 803, 172/805, 809; 37/142 R, 142 VL, 141

[56] References Cited

U.S. PATENT DOCUMENTS

| | | | |
|---|---|---|---|
| 2,386,025 | 10/1945 | Wills | 172/805 |
| 3,631,931 | 1/1972 | Frisbee | 172/807 |
| 3,759,110 | 9/1973 | Davis | 172/805 |
| 4,076,080 | 2/1978 | Anderson | 172/247 |

*Primary Examiner*—Richard J. Johnson
*Attorney, Agent, or Firm*—Dressler, Goldsmith, Clement, Gordon & Shore, Ltd.

[57] ABSTRACT

A mounting arrangement for mounting a dozer blade on a vehicle so that it is capable of being tilted, angled, and raised and lowered is disclosed herein. The mounting structure includes a member that is adapted to be attached to the vehicle and defines a vertical pivot axis which supports a bracket that is pivoted through a fluid ram attached to the bracket and the vehicle. The bracket supports a pair of arms that are connected thereto through universal connections which are located on a common horizontal axis and the blade is attached to the opposite ends of the arms through further universal connections so that the blade can be raised and lowered by a lift fluid ram interposed between the bracket and the blade. A rigid link is connected to one of the arms and to the blade above the connection for the arm while the second arm has a single tilt fluid ram connected thereto and to the blade so that extension and retraction of the tilt fluid ram will tilt the lower edge of the blade.

6 Claims, 4 Drawing Figures

MOUNTING ARRANGEMENT FOR DOZER BLADE

BACKGROUND OF THE INVENTION

The present invention relates generally to vehicles having dozer blades mounted thereon and more particularly to a mounting arrangement wherein the entire mounting mechanism can be formed separately and can readily be attached to any vehicle with minimum modification thereof.

Various types of mounting arrangements for bulldozer blades have been proposed. A typical mounting arrangement for a dozer blade usually consists of a C-frame that has arms extending along opposite sides of the vehicle and the arms are attached for pivotal movement adjacent the rear of the vehicle or tractor. The blade is then supported in some manner on the bite portion of the C-shaped frame and numerous hydraulic rams are positioned at selected locations so that the blade may be angled, tilted, and raised and lowered.

While such arrangements have been found satisfactory for construction of large bulldozers, they are too complicated and expensive for use in mounting a blade on smaller vehicles. Furthermore, the wide C-shaped frame increases the overall width of the small vehicle and therefore decreases the versatility of the unit. For example, proposals have been made for attaching a backfill blade to a small vehicle without the use of the large C-shaped frame. One example of the simplified attachment for a backfill blade to a small vehicle is disclosed in U.S. Pat. No. 3,759,110, assigned to the assignee of the present invention, which discloses a mounting arrangement for a blade that is capable of being angled and laterally shifted to provide blade overhang on either side of the vehicle during operation.

Another type of mounting mechanism that has been developed by the assignee of the present invention includes a bracket structure that is pivoted on a vehicle through a fluid ram and pivotally supports a pair of arms that have the blade attached to the outer end thereof. The arms and blade are raised and lowered through the use of a fluid ram interposed between the bracket and the blade.

One of the inherent shortcomings of both of these types of mounting arrangements is that there is no capability of tilting the blade about a longitudinal axis to change the angle of orientation of the lower edge of the blade with respect to the ground.

SUMMARY OF THE INVENTION

According to the present invention, the mounting arrangement for attaching a blade to a vehicle is designed to be capable of angling, tilting, and raising and lowering the blade utilizing an extremely simple yet rigid construction and the mounting arrangement can be attached to any vehicle with only minimum modification thereof. Furthermore, the mounting arrangement is designed so that it can readily be removed from the vehicle when desired.

More specifically, the mounting arrangement includes a mounting bracket that is attachable to an end of a vehicle intermediate opposite sides thereof, such as between the wheels, and defines a vertical pivot axis upon which a bracket structure is pivotally mounted. The bracket structure pivotally supports a pair of arms at horizontally spaced locations and the arms have opposite ends which are connected at horizontally spaced locations by universal connections on the lower edge of the backfill blade. A single lift fluid ram is interposed between the bracket structure and the blade for raising and lowering the blade while a single angle fluid ram is interposed between the vehicle and the bracket structure for pivoting the bracket structure, arms and blade as a unit for angling the blade. The mounting arrangement also includes a rigid link of fixed length having one end connected to an intermediate portion of one arm and an opposite end connected by a universal connection to the blade while a tilt fluid ram has one end connected to an intermediate portion of the other of the arms and an opposite end connected by a universal connection to the blade. The mounting arrangement also has a sway bar interposed between the arms for accurate blade control. Thus, extension and retraction of the single tilt fluid ram will change the angular orientation of the lower edge of the blade with respect to a horizontal plane.

The blade also has a torque tube extending along the entire length thereof adjacent the lower edge to rigidify the blade against the torsional stresses that are developed during the tilting of the blade.

DETAILED DESCRIPTION

Figure 1:
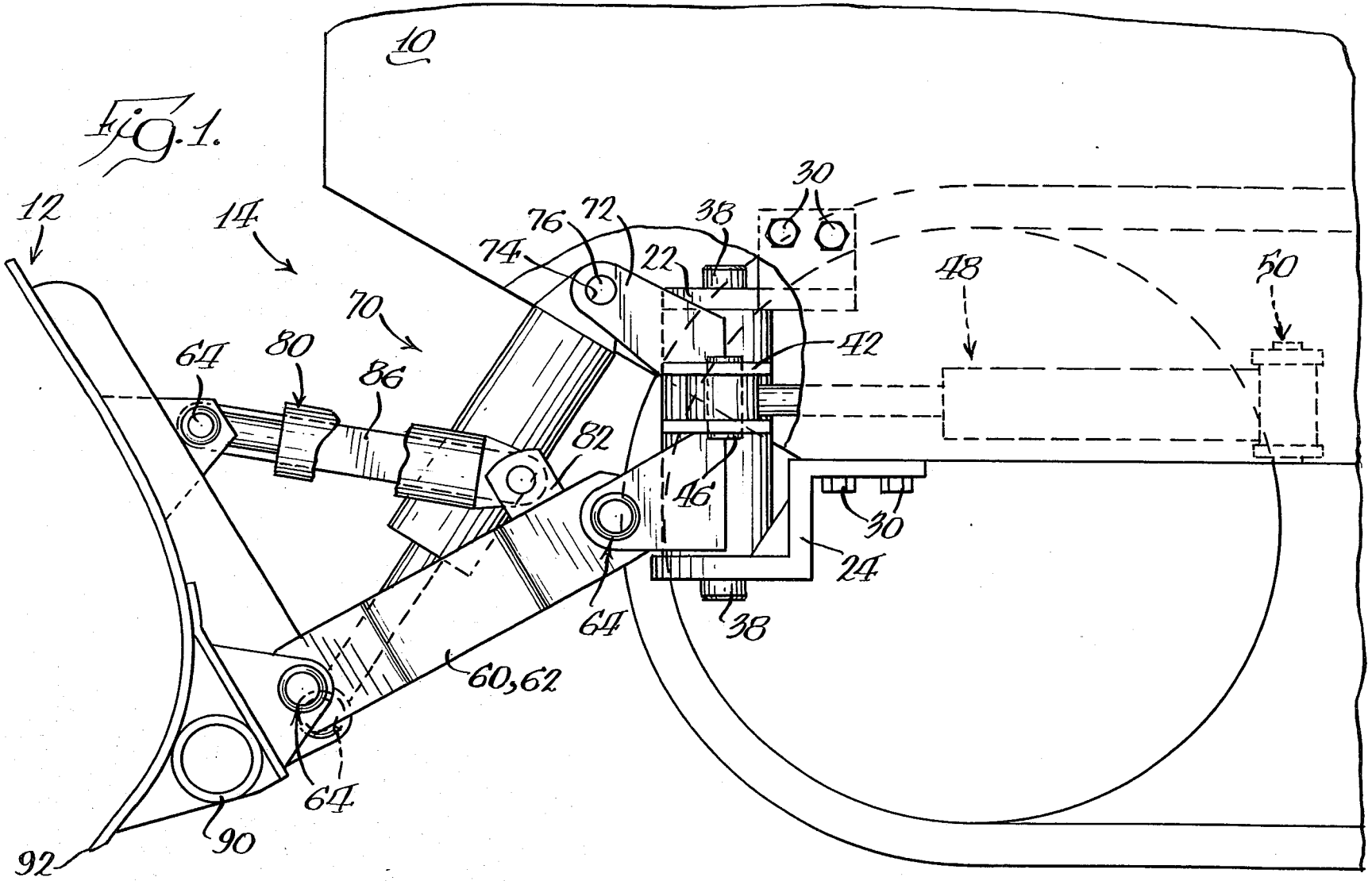
FIG. 1 shows a fragmentary side elevation view of a vehicle having a dozer blade mounted thereon.

While this invention is susceptible of embodiment in many different forms, there is shown in the drawings and will herein be described in detail a preferred embodiment of the invention with the understanding that the present disclosure is to be considered as an exemplification of the principles of the invention and is not intended to limit the invention to the embodiment illustrated.

FIG. 1 of the drawings generally indicates a fragmentary portion of a vehicle designated by the reference numeral 10 having a backfill blade 12 secured to one end thereof through a mounting arrangement, generally designated by the reference numeral 14.

Mounting arrangement 14 is a compact rigid unit that can readily be attached to and detached from the vehicle in a short period of time so that the dozer blade 12 can readily be removed when it is not needed. The mounting arrangement also incorporates the capability of angling blade 12, tilting the blade about a longitudinal axis for the vehicle, and raising and lowering the blade with respect to the ground.

Mounting arrangement 14 includes a mounting means 20 (FIG. 3) consisting of upper and lower spaced plates 22 and 24 each of which has a mounting ear 26 having an opening 28 therein. Plates 22 and 24 have attaching means in the form of openings 29 for attaching the mounting means 20 to vehicle 10 through the use of bolts 30 (FIG. 1). Mounting arrangement 14 also includes a bracket structure 36 that has pins 38 extending from upper and lower end portions thereof and pins 38 are adapted to be received into openings 28 so that the bracket structure is pivoted on the vertical pivot axis.

Bracket structure 36 also has an enlarged column portion 40 located between pins 38 with column portion 40 having a pair of ears 42 extending laterally from one side thereof. The ears 42 have openings 44 for receiving a pin 46 (FIG. 1) for attachment of one end of a fluid ram 48 to bracket structure 36. The opposite end of fluid ram 48 is connected to the vehicle through a suitable connection 50. Thus, extension and retraction of a single fluid ram or cylinder and piston assembly 48 will pivot bracket structure 36 about a vertical pivot axis defined by openings 28.

Bracket structure 36 also has a pair of members 54 extending from column 40 which define horizontally spaced legs that have openings 56 therein. Members 54 are rigidified by a gusset plate 58 interconnecting lower edges thereof. A pair of lift arms 60 and 62 respectively have one end connected by a universal connection 64 to the respective legs having the openings 56 therein.

The opposite ends of arms 60 and 62 are likewise connected by universal connections 64 at horizontally spaced locations adjacent the lower edge of dozer blade 12.

Figures 2, 3, 4:
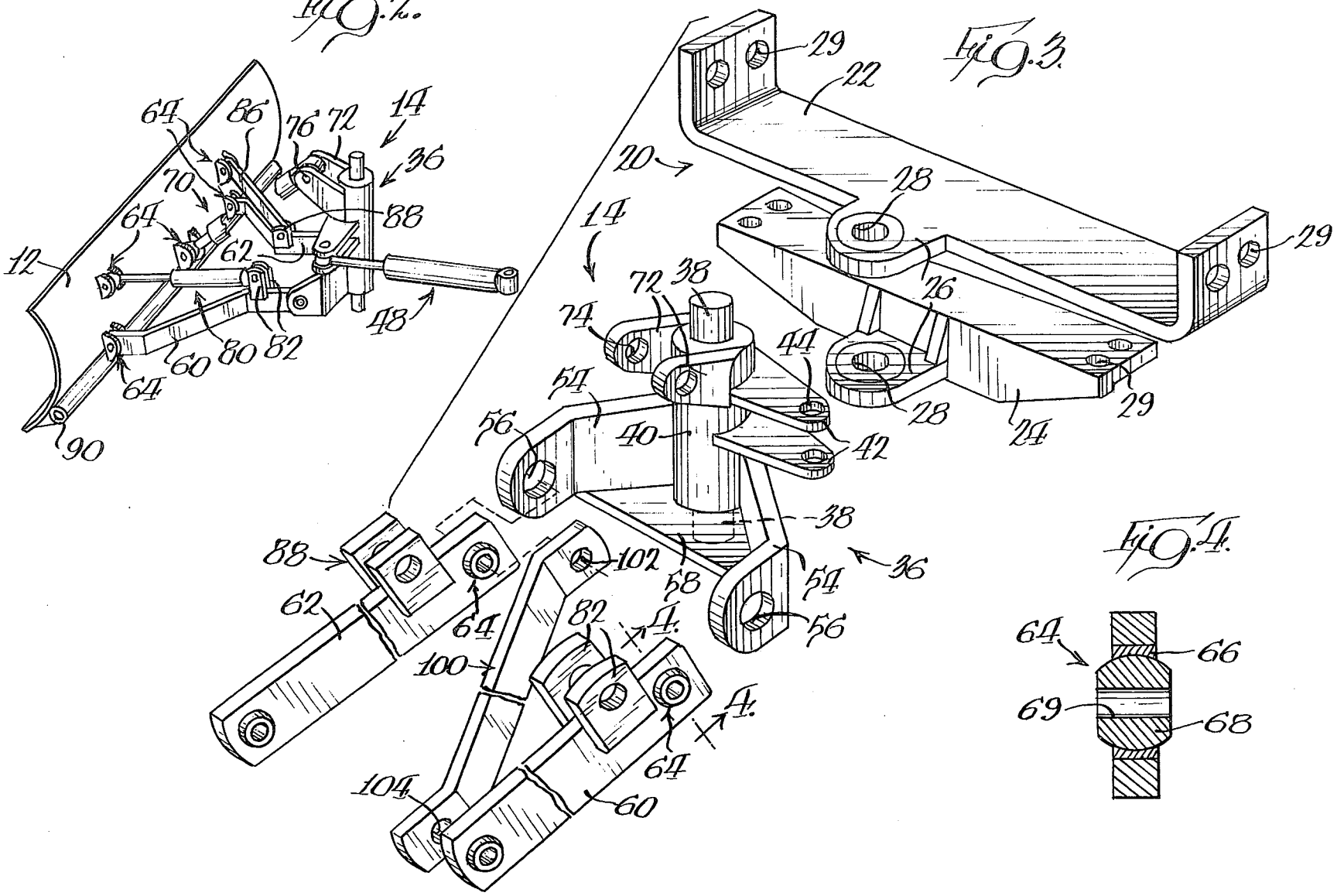
FIG. 2 is a fragmentary perspective view of the mounting mechanism for the blade.
FIG. 3 is an exploded fragmentary perspective view of a portion of the mounting arrangement.
FIG. 4 is a sectional view showing an exemplary universal connection.

An illustrative type of universal connection 64 is shown in FIG. 4 and includes a bushing 66 having a spherical inner surface which receives a sleeve 68 having a corresponding spherical outer surface and an opening 69 for receiving a pin (not shown) to connect one end of either arm 60 or 62 to members 54.

Mounting arrangement 14 also has a single lift fluid ram 70 interposed between bracket structure 36 and blade 12. For this purpose, bracket structure 36 has a pair of ears 72 having openings 74 therein for receiving a pin 76 for attaching the head end of the cylinder of fluid ram 70 to bracket structure 36. The opposite end or the piston rod of fluid ram 70 is connected to blade 12 adjacent the lower edge thereof again through a universal connection 64. Therefore, extension and retraction of fluid ram 70 will raise and lower blade 12 by having arms 60 and 62 pivoted on members 54.

Mounting arrangement 14 also has a tilt fluid ram 80 having one end pivotally supported on a pair of ears 82 fixed to arm 60 to define a pivotal connection therebetween. The opposite end or piston rod of fluid ram 80 is connected to blade 12 through a universal connection 64 that is located directly above and spaced from the pivotal connection for arm 60.

The opposite arm 62 has a rigid link of fixed length 86 pivotally connected to arm 62 at one end thereof through a fixed bracket structure 88 mounted on arm 62. The opposite end of rigid link 86 is connected by a further universal joint 64 to blade 12 directly above the connection for arm 62.

Thus, all of the connections of the various members to blade 12 are made through universal connections, for a purpose that will be described later.

Blade 12 preferably also has a reinforcing member in the form of a torque tube 90 that extends the entire length of blade 12 adjacent the lower edge 92 thereof.

Mounting arangement 14 also includes rigidifying means between arms 60 and 62, more specifically blade 12 and mounting structure 36, to prevent transverse movement of blade 12 with respect to bracket structure 36. In the illustrated embodiment, the rigidifying means for preventing transverse movement includes a sway bar or link 100 of fixed length having an opening 102 at one end for connecting the link to the connection between member 54 and arm 62. The opposite end of sway bar 100 has an opening 104 for connection to the connections between arm 60 and blade 12.

The sway bar 100 prevents transverse movement between bracket structure 36 and blade 12 to provide more accurate control of the blade. Sway bar 100 also takes up side thrust loads when the blade is angled with respect to the vehicle.

The operation of the overall unit is believed to be understood from the above description but will be briefly summarized at this point. Angling of the blade is accomplished through actuation of the single fluid ram 48 which will pivot bracket structure 36, arms 60, 62, fluid rams 70 and 80, rigid link 86 and blade 12 as a unit about pins 38 that define the vertical pivot axis. Of course, during such pivotal movement of the bracket structure the angular position of the blade is changed with respect to the transverse axis for vehicle 10. Also, the appropriate end of the blade will be moved to an offset position with respect to the adjacent end of the vehicle so that the blade is located outside the vehicle wheels.

Likewise, actuation of fluid ram 70 will raise and lower the blade by having arms 60 and 62 pivoted about a horizontal pivot axis defined on bracket structure 36. In addition, tilting of the blade with respect to the longitudinal axis of the vehicle is accomplished by extending and retracting fluid ram 80. This extension and retraction will change the configuration of a triangle defined by fluid ram 80, arm 60 and the vertical portion of blade 12 between universal connections 64. However, the triangulation of the other arm 62, rigid link 86 and the vertical portion of blade 12 will remain the same. Therefore, if fluid ram 80 is extended, the adjacent end of blade 12 will be lowered and if the fluid ram 80 is retracted the adjacent end of the blade will be raised. This will change the angular orientation of the lower edge 92 of blade 12 with respect to a horizontal reference plane. Preferably, the fluid ram 80 is in an intermediate position when lower edge 92 of blade 12 extends parallel to the horizontal reference plane so that extension and retraction of fluid ram 80 is capable of moving blade 12 in both directions with respect to a horizontal reference plane.

As can be appreciated from the above description, the present invention provides a unique arrangement wherein a blade can be angled, raised and lowered, and tilted by the use of three fluid rams and the entire mechanism is an extremely compact structure providing the necessary rigidity for the overall arrangement. Furthermore, the mounting arrangement, particularly the mounting means 14, is designed so that it can readily be attached to any vehicle merely by making holes in the vehicle body frame for attachment of plates 22 and 24 thereto. Furthermore, the mounting arrangement can readily be removed from the vehicle in a short period of time.

We claim:

1. In a vehicle having a dozer blade supported thereon, a mounting arrangement for attaching said dozer blade to said vehicle comprising mounting means defining a vertical pivot axis on said vehicle, a bracket structure pivoted on said vertical pivot axis, a single angle fluid ram connected to said vehicle and said bracket structure for pivoting said bracket structure about said vertical pivot axis, a pair of arms each having one end connected by a universal connection to said bracket structure at horizontally spaced locations, said arms having opposite ends connected by universal connections at horizontally spaced locations on said dozer blade, rigidifying means between said bracket structure and said blade preventing transverse movement therebetween, a single lift fluid ram having one end pivoted on said bracket structure and an opposite end pivoted by a universal connection on said blade, a single tilt fluid ram having one end connected to one of said arms and an opposite end connected by a universal connection to said dozer blade, and a rigid link of fixed length having one end connected to the other of said arms and an opposite end connected by a universal connection to said dozer blade so that actuation of said angle fluid ram will pivot said bracket structure, arms and dozer blade as a unit about said vertical pivot axis, actuation of said lift fluid ram will pivot said arms and dozer blade as a unit about a horizontal pivot axis on said bracket structure, and actuation of said tilt fluid ram will change the angular orientation of a lower edge of said dozer blade with respect to a horizontal plane.

2. A vehicle as defined in claim 1, in which said tilt fluid ram is in an intermediate position when said lower edge is in line with said horizontal plane so that extension of said tilt fluid ram will lower an adjacent end of said lower edge and retraction of said tilt fluid ram will raise said adjacent end of said lower edge.

3. A vehicle as defined in claim 1, further including reinforcing means fixed to said dozer blade adjacent said lower edge.

4. A vehicle as defined in claim 3, in which said reinforcing means includes a torque tube secured to said dozer blade and extending the length thereof.

5. A vehicle as defined in claim 1, in which said arms are connected to said dozer blade adjacent said lower edge and said link and tilt fluid rams are located above said arms.

6. A vehicle as defined in claim 1, in which said rigidifying means includes a fixed link having one end connected to said connection between one arm and said bracket structure and an opposite end connected to said connection between the other arm and said blade.

* * * * *